United States Patent [19]

Eldridge

[11] Patent Number: 4,980,602

[45] Date of Patent: Dec. 25, 1990

[54] ELECTRIC LAMP AND SOCKET THEREFOR

[76] Inventor: Bruce E. Eldridge, 688 MacCulloch Dr., Los Angeles, Calif. 90049

[21] Appl. No.: 389,244

[22] Filed: Aug. 2, 1989

[51] Int. Cl.[5] ..... H01J 5/50; H01J 5/62; H01R 13/73

[52] U.S. Cl. ..... 313/318; 313/51; 439/544; 439/558

[58] Field of Search ..... 313/318, 51; 439/151, 439/226, 230, 544, 558, 679

[56] References Cited

U.S. PATENT DOCUMENTS

| | | | |
|---|---|---|---|
| 484,207 | 10/1892 | Klein | 439/936 X |
| 819,437 | 5/1906 | Jones | 313/51 X |
| 3,281,620 | 10/1966 | Miller | 313/318 X |

*Primary Examiner*—Sandra L. O'Shea

*Attorney, Agent, or Firm*—Nilsson, Robbins, Dalgarn, Berliner, Carson & Wurst

[57] ABSTRACT

An incandescent electric lamp and a socket for receipt of the lamp. The socket contains an insulator to prevent completion of the electrical circuit for illuminating the filament contained within the lamp except when the lamp has a wattage rating which is equal to or less than the wattage rating for which the socket is designed. When the wattage rating is proper, the central contact assembly of the base of the electric lamp bypasses the insulator to establish a completed electrical circuit. In one embodiment, the insulator defines an opening of a predetermined diameter through which a protrusion on the base of the lamp extends when its diameter is equal to or less than the opening in the insulator. In an alternative embodiment, the insulator has a diameter of a predetermined value while the central contact assembly defines a depression having a diameter which is equal to or greater than the diameter of the insulator.

10 Claims, 1 Drawing Sheet

FIG. 1
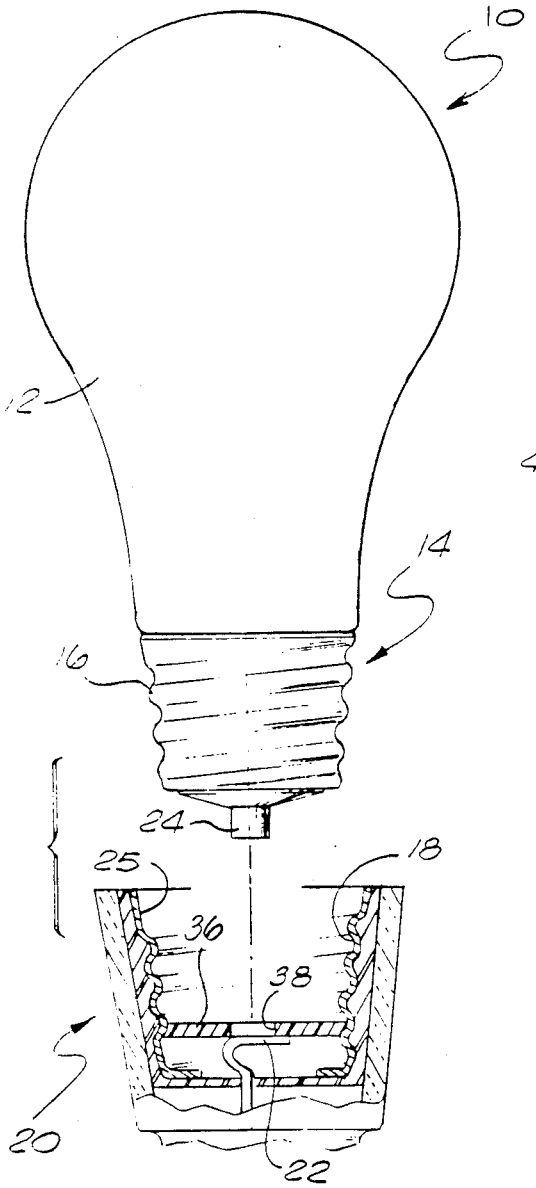
FIG. 2
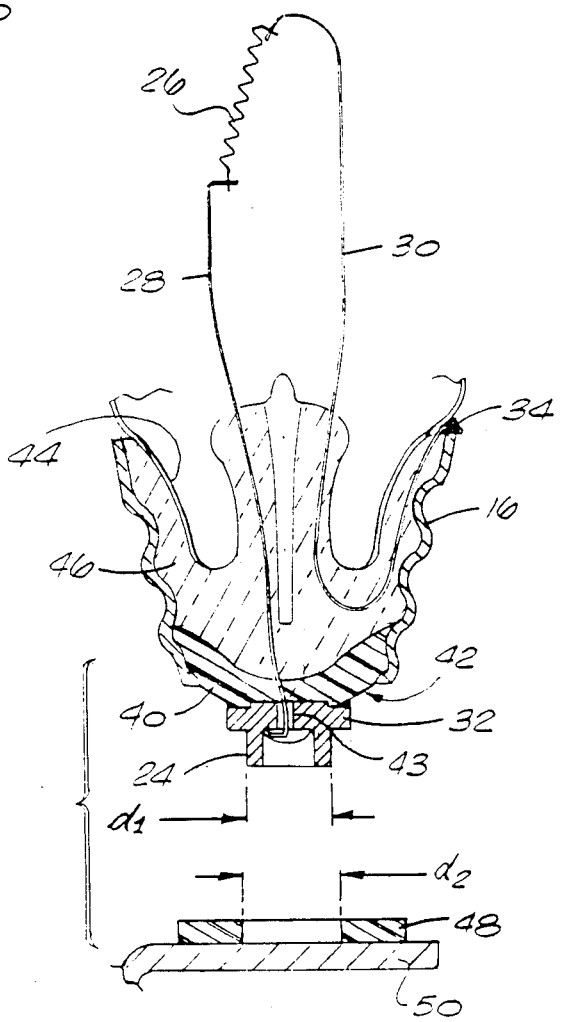
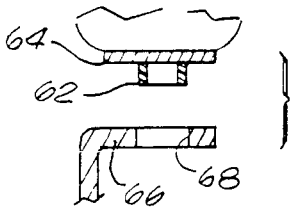
FIG. 4
FIG. 3
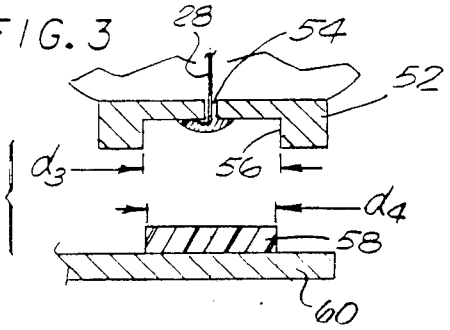
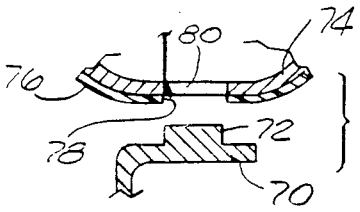
FIG. 5

ELECTRIC LAMP AND SOCKET THEREFOR

BACKGROUND OF THE INVENTION

This invention relates generally to incandescent electric lamps and more particularly to an improvement which precludes the use of incandescent electric lamps of excess wattage in those fixtures wherein incandescent lamps of a predetermined limited wattage are to be used.

There are many incandescent lamp receiving fixtures wherein lamps of a predetermined limited wattage are to be utilized. For example; in many fixtures, if lamps of a high wattage are inserted and illuminated, the heat generated by the incandescent electric lamp may damage a portion of the fixture; such for example as the shade. Alternatively, it has been determined that in some instances damage resulting to the socket can result in a short circuit which in turn leads to a fire. In other instances, enclosures receiving the electric lamp may be damaged or alternatively sufficient heat generated such that damaged or alternatively sufficient heat generated such that those coming in contact with the fixture may possibly injure themselves.

At the present time, all incandescent electric lamps designed for illumination by standard household current of 110 volts have a standard threaded base adapted to be received within a threaded socket irrespective of the wattage of the bulb. As a result, even though a particular fixture is designed to receive an incandescent electric lamp of limited wattage, there is no known means for precluding the user from inserting an incandescent lamp having an excess wattage into that particular fixture.

There are numerous polarizing devices utilized in electrical connectors to assure proper interconnection of the male and female contacts thereof, such for example as those shown in U.S. Pat. No. 3,582,867 and 3,885,849. There are also known modifications to the traditional electric lamp socket to adapt it to receive lamps of various construction other than the standard incandescent electric lamp, such for example as those shown in U.S. Pat. No. 4,683,402 which adapts such a socket to receive fluorescent lights and U.S. Pat. No. 3,356,984 which allows a bulb to be inserted or removed by axial movement as well as U.S. Pat. No. 438,310 which illustrates various modifications of the electric lamp base for receipt in various configurations of electric lamps sockets. Applicant, however, is unaware of any prior art which teaches a structure adapted to limit the wattage of an incandescent electric lamp receivable within a socket therefor.

SUMMARY OF THE INVENTION

An incandescent electric lamp for threadable engagement in a socket carrying an insulator member over the central electrical terminal thereof including an envelope having a filament and electrical wires contained therein, a base secured to the envelope and having an appropriate outer threaded shell for receipt within the socket and a central contact assembly insulated therefrom for conveying electrical current from the socket to the filament, insulating means precluding completion of the electrical circuit to said filament, the central contact assembly carries means for bypassing the insulating means only when the incandescent electric lamp has a wattage rating which is equal to or less than the wattage rating for which the socket is designed.

BRIEF DESCRIPTION OF THE DRAWING

FIG. 1 is a plan view partly in cross section illustrating an incandescent electric lamp and socket constructed in accordance with the principals of the present invention;

FIG. 2 is a fragmented cross sectional view of the base of the lamp and the central contact of the socket as illustrated in FIG. 1;

FIG. 3 is a partial cross sectional view illustrating an alternative embodiment of a portion of the central contact assembly of the lamp and the center contact of the socket constructed in accordance with the principals of the present invention;

FIG. 4. is a fragmentary cross sectional view of another embodiment of the invention; and FIG. 5 is a fragmentary cross sectional view of yet another embodiment of the invention.

DETAILED DESCRIPTION

The utilization of incandescent electric lamps of predetermined minimal wattage ratings is desirable under numerous circumstances. Such lamps can conserve energy in those situations where a particular area need not be brightly illuminated. Through utilization of such limited wattage incandescent lamps, one can in advance determine the total wattage to be used within a given area, thus allowing better efficiency in utilization of electric energy. In addition to the foregoing, the utilization of such limited wattage electric lamps would also better enable the planning of electrical circuits for utilization in homes. In addition to the foregoing as above mentioned, there are instances where particular fixtures can only utilize incandescent lamps of a predetermined limited wattage to be safe.

As is shown in the drawings, an incandescent electric lamp 10 constructed in accordance with the principals of the present invention includes an envelope 12 and a base assembly 14. The base assembly includes an outer shell 16 defining helical threads which are threadably received by complimentary threads 18 contained within a socket assembly shown generally at 20. The socket assembly also includes a central electrical contact member 22 which is adapted to make electrical contact with a central electrically conductive member 24 of the base assembly 14 of the lamp 10.

As is well known to those skilled in the art, electrical current is carried by a pair of electrical wires (not shown), one of which is connected to the inner threaded receptacle 25 of the socket while the other is connected to the central electrical terminal 22. A filament 26 has each of its ends connected respectively to a pair of electrical wires 28 and 30. The wire 28 passes through an electrical metal contact 32 and is held in place thereon traditionally by solder or the like. The other electrical wire 30 is attached again as by solder or the like as shown at 34 to the electrically conductive base 16. Therefore, when the lamp 10 is threaded into the socket 20, the electrical circuit is completed so that when electrical power is applied, the filament will glow thus illuminating the lamp 10.

In accordance with the principals of the present invention, there is provided an insulating member which may take many forms and for example is shown in FIG. 1 as a flat plate or washer 36 which may be deposited into the socket 20 and loosely retained therein. Alternatively, the washer 36 may be secured within the socket by a suitable adhesive for example between the washer 36 and the contact 22. Such a structure could be utilized by original equipment manufacturers or by way of retrofitting existing lamps currently in use in many homes where it is desired to limit the wattage of the electric lamp which could be utilized therein. As is illustrated, the insulating washer 36 is provided with a centrally disposed opening 38. When the electric lamp 10 constructed in accordance with the present invention is inserted into the socket 20, the protrusion 24, if it is of the proper diameter, will pass through the opening 38 and make contact with the central connector 22 thus completing the electrical circuit for the filament 26. If, however, the protrusion 24 is larger than the opening 38, the protrusion 24 will contact the insulator 36 thus precluding completion of the electrical circuit for the filament 26.

By referring now more specifically to FIG. 2, the details of construction of the lamp as shown generally in FIG. 1 is illustrated. As is therein shown, the threaded shell 16 has an insulating plug 40 positioned at the lower open end 42 thereof. The plug carries the metal contact 32 which also defines a central opening 43 through which the lead 28 passes for soldering thereto. The lower end 44 of the envelope 12 is secured in place within the base 16 by appropriate cement 46 or the like which is also of insulating material. The protrusion 24 may take the form of an extension of the metal contact 32 formed as by stamping or the like or alternatively may be a metal cap which is secured to the metal contact 32 subsequent to affixing the lead 28 in place. In any event, the protrusion 24 in accordance with the presently preferred embodiment of the invention will have an outside diameter $d_1$ which will represent a predetermined wattage for the lamp 10. The insulator 48 will have an opening therethrough having a diameter $d_2$ which conforms to a predetermined wattage for which the particular socket is designed. That is, the socket will be incorporated into an electrical fixture such as a lamp or the like with the overall fixture being designed to receive a lamp having a predetermined wattage which is represented by the diameter $d_2$ in the opening in the insulator 48. It should also be noted that the insulator 48 as is illustrated in FIG. 2 constitutes a small washer like element which may be adhered to the central contact 50 of the socket by means of any well known adhesive. The only limitation being that the insulator 48 must be aligned upon the centrally electrical contact 50 in such a manner as to be positioned at the point where the center of the lamp will be positioned when screwed into the socket.

It is presently contemplated that the diameters $d_1$ of the protrusions appearing on the incandescent electric lamps 10 will be decreasing in size as the wattage of the lamp decreases. That is, for example a 75 watt lamp would have a protrusion having a diameter of 5/16 of an inch, a 40 watt bulb would have a diameter of $\frac{1}{4}$ inch while a 25 watt bulb would have a diameter of 3/16 of an inch while a 100 watt bulb would have a diameter of $\frac{3}{8}$ of an inch. In accordance with the principals of the present invention, assuming that the diameter $d_2$ as shown in FIG. 2 is 5/16 of an inch, then the 75, 40 or 25 watt bulb would have a protrusion 24 having a diameter $d_1$ substantially equal to or less than the diameter $d_2$, thus allowing the protrusion to pass through the opening $d_2$ in the insulator 48 and make contact with the central electrical connector 50 in the socket to complete the circuit to the filament 26. However, if the 100 watt bulb were inserted into the socket containing such an insulator on the central connector 50, the protrusion 24 would not pass through the opening because its diameter is greater than the diameter $d_2$ therein. Thus, although the bulb would be received within the socket, the electrical circuit would not be completed and the lamp could not be illuminated, and therefore, a positive control could be exerted upon the maximum wattage which could be received within that particular socket.

Although the embodiment shown in FIGS. 1 and 2 includes that where a protrusion extends from the central contact assembly, an alternative embodiment is shown in FIG. 3. As is therein illustrated, the central contact assembly connected to the outer threaded shell of the base includes the electrically conductive metal contact 52 having the central opening 54 which receives the electrical lead 28 as above described. As opposed to a protrusion, however in this instance, the metal contact member has a recess or depression 56 formed therein. The recess has a diameter $d_3$ which defines the wattage of the bulb to which it is affixed. An insulator 58 is affixed to the central contact 60 of the socket as previously described. The diameter of the insulator $d_4$ is such as to define the maximum allowable wattage incandescent lamp receivable within that particular socket. So long as the diameter $d_3$ of the recess is substantially equal to or greater than the diameter $d_4$ of the insulator, electrical contact will be completed and the filament of the lamp will be illuminated. In any instance wherein the diameter $d_3$ was less than the diameter $d_4$ of the insulator, electrical contact would not be completed and the lamp could not be illuminated. Obviously in instances where this type of structure is utilized, the recess would have an increasing diameter as the wattage of the lamp decreased.

It will be appreciated by those skilled in the art that by utilization of a lamp constructed as described and illustrated in FIGS. 1 through 3, the lamp may be received in any of the currently known sockets which do not have the insulator mechanism contained therein and would still be operative. Thus, a lamp constructed in accordance with the invention and as thus far described would not be limited in its utilization except in those cases where a socket having the insulating mechanism therein was utilized.

By referring now more specifically to FIG. 4, there is illustrated yet another alternative embodiment of a lamp constructed in accordance with the principals of the present invention. As is therein shown, a protrusion 62 of insulating material is connected as by adhesive or the like to the metallic contact 64 on the base of the lamp. The center electrical contact 66 contained within the socket defines an opening 68 therethrough. As has above been described, if the diameter of the protrusion 62 is substantially equal to or less than the diameter of the opening 68, the protrusion 62 will pass therethrough. When such occurs, electrical contact is completed between the central contact 66 and the metallic member 64 on the lamp and the lamp can be illuminated. If the protrusion 64 is greater in diameter than the opening 68, then it will make contact with the central member 66 thus precluding completion of the electrical circuit. Obviously, a lamp constructed as is illustrated in FIG. 4 can be utilized only with a socket having the appropriate adaptation with the opening 68 and the central contact 66 thereof and cannot be used in currently available electrical sockets existing on the marketplace.

There has thus been described various embodiments of an electric lamp constructed in accordance with the principals of the present invention which can be utilized in those instances where it is desired to restrict the amount of wattage capable of being consumed by an incandescent electric lamp in any particular application.

By referring now to FIG. 5, there is illustrated yet another embodiment of a lamp constructed in accordance with the principals of the present invention. This embodiment is similar to that of FIG. 4 but with the insulator member carried by the lamp. As is therein shown, the socket central contact 70 has an electrically conductive member 72 having a predetermined diameter affixed thereto. The lamp base 74 includes a layer of insulation 76 about the bottom thereof with the central opening 78 therethrough. Disposed within the opening and recessed therein is the central electrical contact 80 of the lamp. If the opening 78 is larger than the diameter of the protrusion 72, the electrical circuit for the lamp will be completed. Obviously this structure, like that of FIG. 4, cannot be used with currently available sockets on the market.

What is claimed is:

1. An incandescent electric lamp for threadable engagement in a socket comprising:

(a) an envelope containing a filament with electrical wires connected thereto;

(b) a base secured to said envelope and having an outer threaded shell and a central contact assembly insulated from each other for conveying electrical current from said socket to said filament;

(c) insulating means for preventing completion of an electrical circuit between said socket and said electrical wires; and (d) means carried by said central contact assembly for bypassing said insulating means only when said lamp has a wattage rating which is equal to or less than the wattage rating for which said socket is designed to accept.

2. An incandescent electric lamp as defined in claim 1 wherein said means for bypassing includes a protrusion extending from said central contact assembly.

3. An incandescent electric lamp as defined in claim 1 wherein said means for bypassing includes a recess in said central contact assembly.

4. An incandescent electric lamp as defined in claim 1 wherein said insulating means includes an insulator effectively covering a central electrical connector in said socket.

5. An incandescent electric lamp as defined in claim 4 wherein said insulator defines an opening therethrough having a first predetermined diameter $d_2$ and wherein said central contact assembly includes an electrically conductive protrusion therefrom having a second predetermined diameter $d_1$, said insulator being bypassed only when said diameter $d_1$ is substantially equal to or less than said diameter $d_2$.

6. An incandescent electric lamp as defined in claim 5 wherein said insulator means is a flat washer like member received within said socket.

7. An incandescent electric lamp as defined in claim 6 wherein said flat washer like member has a diameter substantially the same as the inner diameter of the socket.

8. An incandescent electric lamp as defined in claim 7 wherein said flat washer like member is affixed to said central electrical contact of said socket.

9. An incandescent electric lamp as defined in claim 5 wherein said insulator means is a washer like member having a diameter less than the inner diameter of said socket affixed to said central electrical contact of said socket.

10. An incandescent electric lamp as defined in claim 4 wherein said insulator means includes a disk of insulating material having a first predetermined diameter $d_4$ affixed to a central electrical contact of said socket;

said bypassing means includes a recess in said central contact assembly having a second predetermined diameter $d_3$, said insulator member being bypassed only when said diameter $d_3$ is substantially equal to or greater than said diameter $d_4$.

* * * * *